US007255339B2

(12) United States Patent
Hung et al.

(10) Patent No.: US 7,255,339 B2
(45) Date of Patent: Aug. 14, 2007

(54) SHEET-FEEDING APPARATUS WITH A PAPER STOPPER

(75) Inventors: Ming-Te Hung, Hsinchu (TW); Kuo-Ming Lai, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 0 days.

(21) Appl. No.: 11/327,252

(22) Filed: Jan. 7, 2006

(65) Prior Publication Data

US 2007/0158898 A1 Jul. 12, 2007

(51) Int. Cl.
*B65H 3/52* (2006.01)

(52) U.S. Cl. ..... 271/122; 271/121

(58) Field of Classification Search ..... 271/121–122, 271/124–125, 114

See application file for complete search history.

(56) References Cited

U.S. PATENT DOCUMENTS 6,431,541 B2 * 8/2002 Kuo et al. ..... 271/118
6,547,235 B2 * 4/2003 Higaki ..... 271/10.01

* cited by examiner

*Primary Examiner*—Patrick Mackey
*Assistant Examiner*—Gerald W McClain

(57) ABSTRACT

A sheet-feeding apparatus with a paper stopper includes a sheet-feeding base having a sheet-placing stand for placing sheets, a roller shell located on the sheet-feeding base having two side walls, a preliminary feeding roller unit and a feeding roller unit contained in the roller shell, a stopper member rotationally attached to the side wall of the roller shell and a follower member rotationally attached to the feeding roller unit and located at the downstream side of the stopper. Before starting a feeding operation, the stopper member is pushed by a sheet in the sheet-feeding base to move forward and presses on the follower member. The follower member would not move any further because the follower member is restricted by an upright wall of the sheet-feeding base.

5 Claims, 13 Drawing Sheets

(Proir Art)

SHEET-FEEDING APPARATUS WITH A PAPER STOPPER

BACKGROUND OF THE INVENTION

1. Field of the Invention

The present invention relates generally to a sheet-feeding apparatus, and more particularly, to a sheet-feeding apparatus with a paper stopper.

2. The Related Art

Office machine, such as printers, scanners, copiers and the like, generally includes a sheet-feeding apparatus for feeding papers into the office machine. The sheet-feeding apparatus is generally provided with a stopper mechanism. When the sheets are placed on a sheet-supplying tray of the office machine, the stopper mechanism protrudes into the sheet entrance or path to restrict the leading edge of the sheet to prevent the sheet from entering into the machine. When the sheet operation starts, the stopper mechanism retracts from the sheet entrance to allow the sheet to advance into the machine.

FIG. 18 is a cross-sectional view illustrating a conventional sheet-feeding apparatus. The sheet-feeding apparatus comprises a preliminary feeding roller unit 92 for taking a sheet from a sheet-placing unit 96. A feeding roller unit 93 is located at downstream of the preliminary feeding roller unit 92 in the sheet-transferring direction.

The feeding roller unit 93 has a supporting shaft 93*a* to which a lever 97 is rotationally attached. A lever 97 has a swinging end to which a supporting shaft 92*a* of the preliminary feeding roller unit 92 is rotationally attached. A rotational force is given to the feeding roller unit 93 from a driving motor (not shown) and the rotational force is also transmitted to the preliminary feeding roller unit 92 through a gear mechanism (not shown).

A sheet stopper 95 is disposed between the preliminary feeding roller unit 92 and the feeding roller unit 93. The sheet stopper 95 swings. A locking mechanism 98 for locking the swinging of the sheet stopper 95 is located at the upside end of the sheet stopper 95. This locking mechanism 98 has a driving means, such as a solenoid, for locking and releasing the sheet stopper 95.

When the solenoid is energized, the sheet stopper 95 swings and allows the sheet to be transferred to the feeding roller unit 93. When the solenoid is not energized, the sheet stopper 95 is locked by the locking mechanism 98 to prevent the sheet from being transferred to the feeding roller unit 93.

When the sheet is set, the preliminary feeding roller unit 92 is raised and the sheet stopper 95 is locked in order to prevent the sheet from being transferred to the feeding roller unit 93.

When the sheet stopper 95 is released, the sheet enters into the sheet-feeding passage while the sheet stopper 95 is swinged by the sheet.

Such design further requires an electric system to supply driving power to the driving motor. The gear mechanism is also provided for transferring the rotational force from the driving motor to the preliminary feeding roller unit 92 and the feeding roller unit 93. This design complicates the structure of the apparatus and increases the cost of manufacture.

SUMMARY OF THE INVENTION

It is an object of the present invention to provide a sheet-feeding apparatus with a paper stopper which comprises a sheet-feeding base for placing sheets thereon, a roller shell having two side walls and being located on the sheet-feeding base, a preliminary feeding roller unit engaging with the roller shell, a feeding roller unit passing through the side walls and engaging with the sheet-feeding base, a stopper member rotationally attached to the roller shell and a follower member rotationally sleeved on the feeding roller unit and engaged with the sheet-feeding base. When the roller shell is positioned in first position, the preliminary feeding roller unit keeps a considerable distance from a sheet-placing stand of the sheet-feeding base and the stopper member contacts with the leading edge of the sheet. A holding portion of the stopper member contacts with the follower member and the follower member contacts with an upright wall of the sheet-feeding base. When the roller shell is positioned in second position, the preliminary feeding roller unit contacts with the sheet and advances the sheet in the sheet-transferring direction. Then, the advancing sheet pushes the stopper member to rotate clockwise. Consequently, the stopper member pushes the follower member to rotate counter-clockwise. As a result, the sheet moves forward. Meanwhile, the feeding roller unit rotates clockwise and keeps forcing the sheet to move forward in the sheet-transferring direction.

In summary, the sheet-feeding apparatus with a paper stopper of the present invention stops sheets advancing by mechanism cooperation. The structure of the sheet-feeding apparatus of the present invention is simplified and easy to be manufactured.

DETAILED DESCRIPTION OF THE PREFERRED EMBODIMENT

Figure 1:
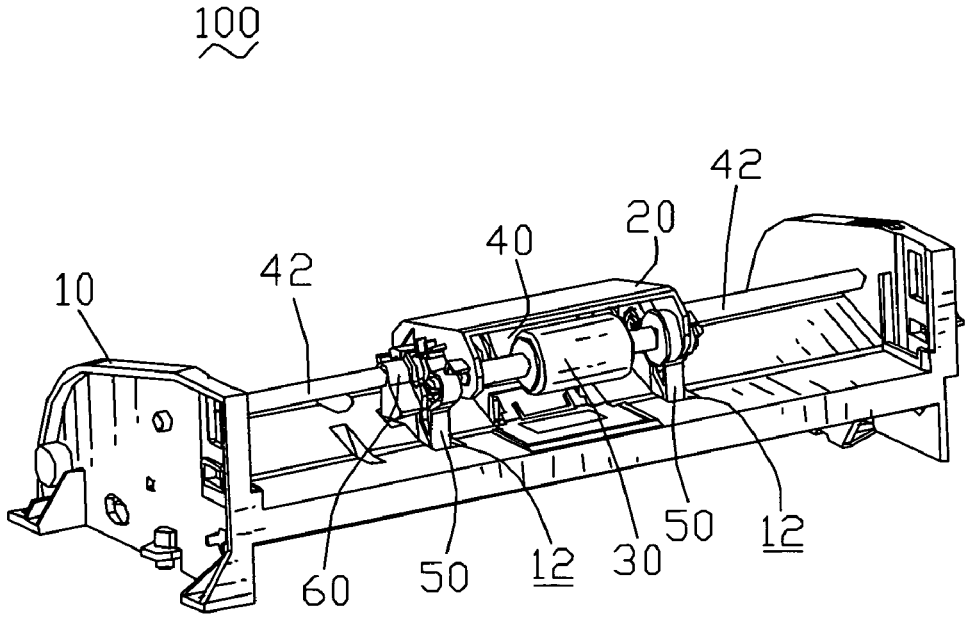
FIG. 1 is a perspective view of a sheet-feeding apparatus with a paper stopper according to the present invention.

FIG. 1 is a perspective view illustrating a sheet-feeding apparatus with a paper stopper 100 according to an embodiment of the present invention. The sheet-feeding apparatus with a paper stopper 100 comprises a roller shell 20 which contains a preliminary feeding roller unit 30 and a feeding roller unit 40 therein. The feeding roller unit 40 has a second shaft 42 passing through the roller shell 20 and is disposed in a sheet-feeding base 10 for securing the roller shell 20 thereon. A stop member 50 and a follower member 60 are attached to the roller shell 20. The preliminary feeding roller unit 30 is placed at the upstream side of the feeding roller unit 40 in the sheet-transferring direction. The stop member 50 is placed at the upstream side of the follower member 60 in the sheet-transferring direction.

Figure 2:
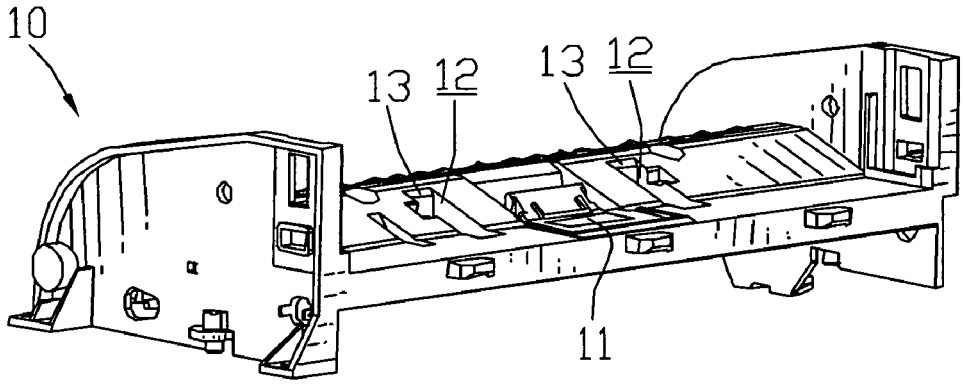
FIG. 2 is a perspective view of a sheet-feeding base of the sheet-feeding apparatus with a paper stopper.

As best seen in FIG. 2, the sheet-feeding base 10 has a sheet-placing stand 11 for stacking a plurality of sheets and forms a sheet-transferring passage in the sheet-transferring direction. A plurality of parallel rectangle slots 12 is located in the sheet-placing stand 11 and a plurality of upright walls 13 are formed at the end of each of the slots 12.

Figure 3:
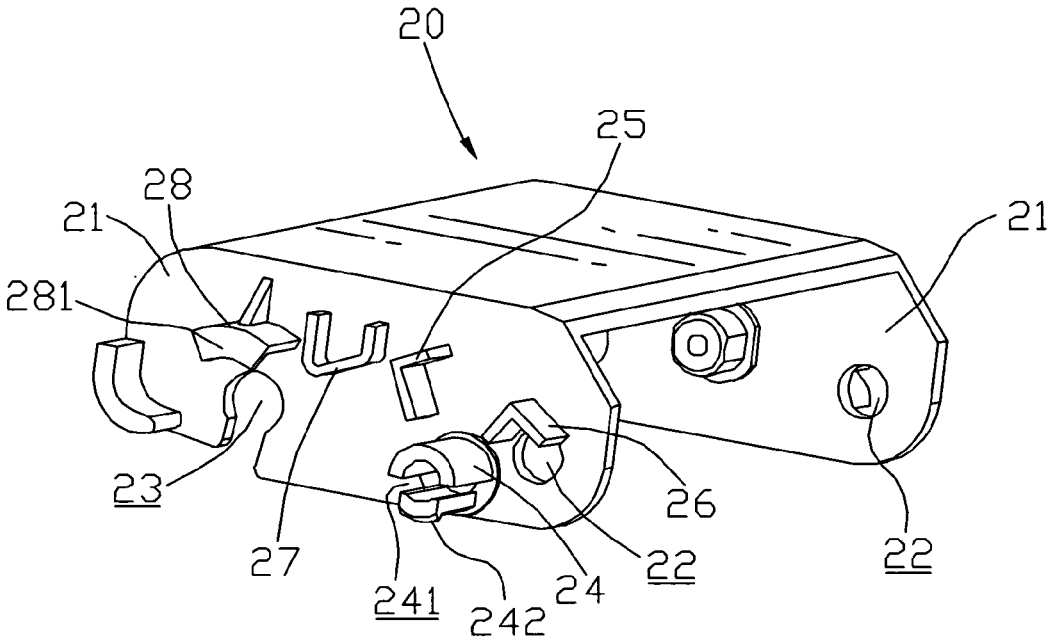
FIG. 3 is a perspective view of a roller shell of the sheet-feeding apparatus with a paper stopper.

The roller shell 20 has two side walls 21 as shown in FIG. 3. Each side wall 21 has a hinge hole 22 located in the front and a hinge orifice 23 located in the end thereof. A ring-shaped hinge shaft 24 protrudes from the side wall 21 and is located between the hinge hole 22 and the hinge orifice 23. The hinge shaft 24 is split into two pieces to form a landscape orientation crevice 241 therebetween. A protruded end 242 projects outwardly from the edge of the hinge shaft 24. A plurality of right-angle stopper blades 25, 26 are formed on the side walls 21. The right-angle stopper blade 26 is arranged at top right side of the hinge shaft 24. The right-angle stopper blade 25 is arranged at the top left side of the hinge shaft 24. The right-angle stopper blades 26 and 25 define a restricted space for the stopper member 50. A U-shaped restricting blade 27 and a cover 28 are formed on the side walls 21. The cover 28 is arranged at up side of the hinge orifice 23. The U-shaped restricting blade 27 is arranged at top right of the hinge orifice 23 to restrict the follower member 60 over-swinging. The right-angle stopper blades 25 and 26, the U-shaped restricting blade 27 and the cover 28 are arranged at similar contour line. A sector face 281 protrudes downwardly from the edge of the cover 28.

Figure 4:
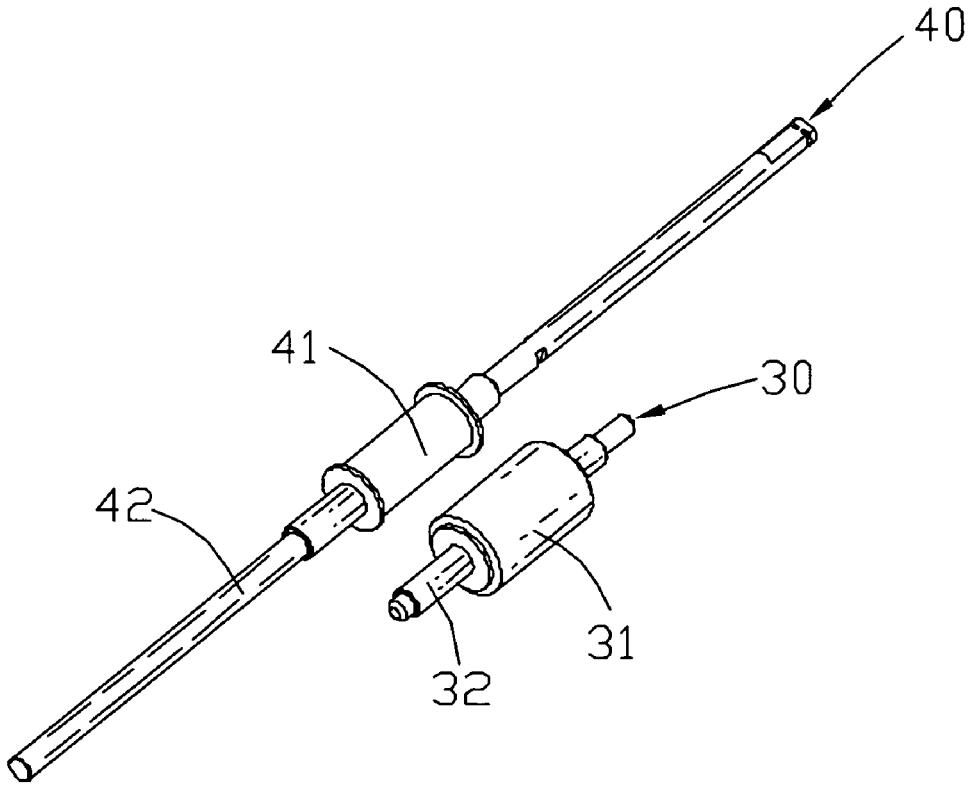
FIG. 4 is a perspective view of a preliminary feeding roller unit and a feeding roller unit of the sheet-feeding apparatus with a paper stopper.

As shown in FIG. 4, the preliminary feeding roller unit 30 comprises a first shaft 32 and a first roller 31 formed around in the middle of the first shaft 32. The first shaft 32 engages with the hinge holes 22 of the side walls 21. Likewise, the feeding roller unit 40 comprises a second shaft 42 and a second roller 41 formed in the middle of the second shaft 42. The second shaft 42 passes through the hinge orifices 23 and engages with the sheet-feeding base 10. The length of the first shaft 32 conforms to that of the roller shell 20 and the length of the second shaft 42 conforms to that of the sheet-feeding base 10.

Figure 5:
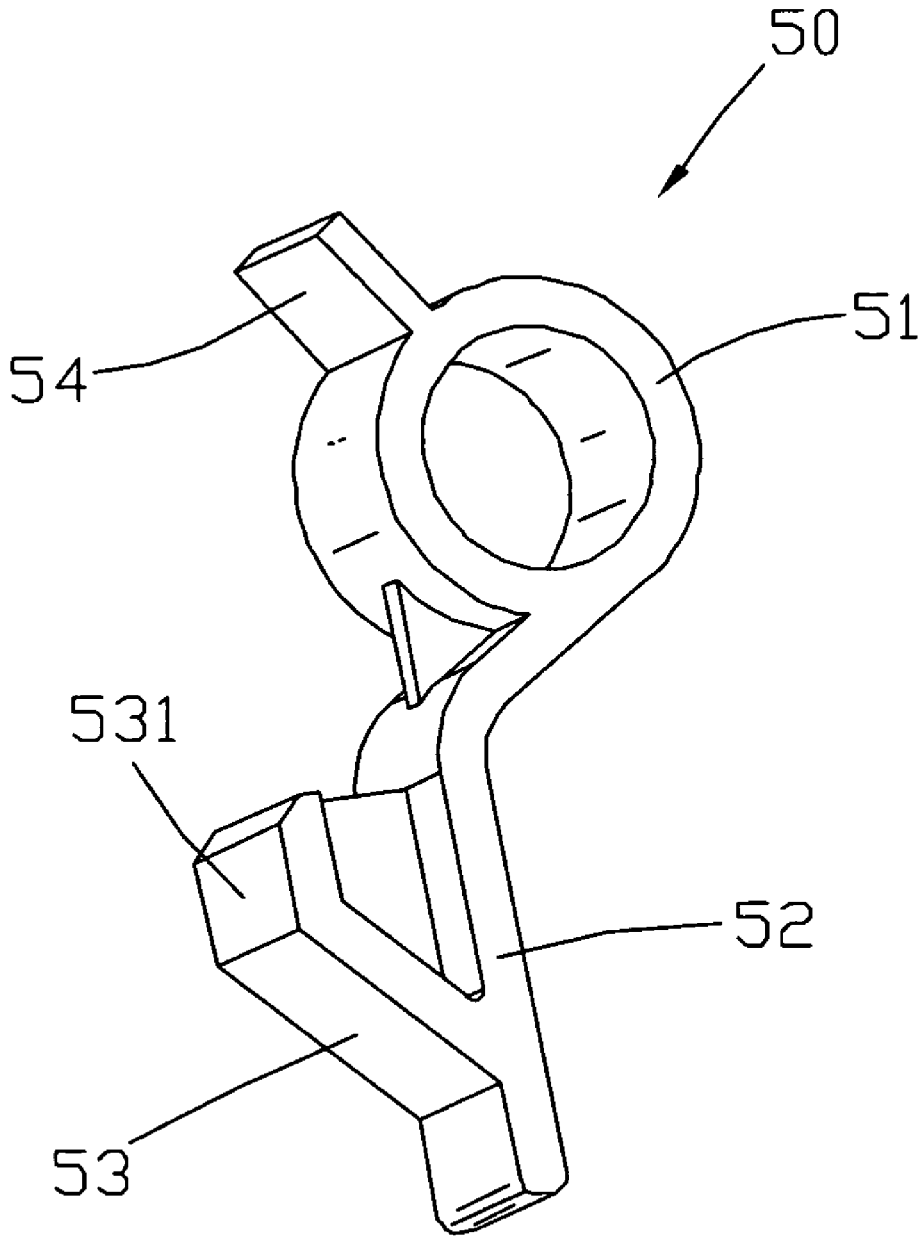
FIG. 5 is a perspective view of a stopper member of the sheet-feeding apparatus with a paper stopper.

The stopper member 50 is shown in great detail in FIG. 5. The stopper member 50 has a first hinge portion 51 rotationally attached to the hinge shaft 24. A supporting blade 54 is formed at the top left corner of the first hinge portion 51. The supporting blade 54 swings in the restricted space defined by the right-angle stopper blades 26 and 25. The first hinge portion 51 extends downwardly and forms a sheet stopper bar 52. A holding portion 53 projects from the end of the sheet stopper bar 52. A holding end 531 is formed at the end of the holding portion 53. The supporting blade 54 moves between the right-angle stopper blades 26 and 25 to restrict the swinging angle of the stopper member 50.

Figure 6:
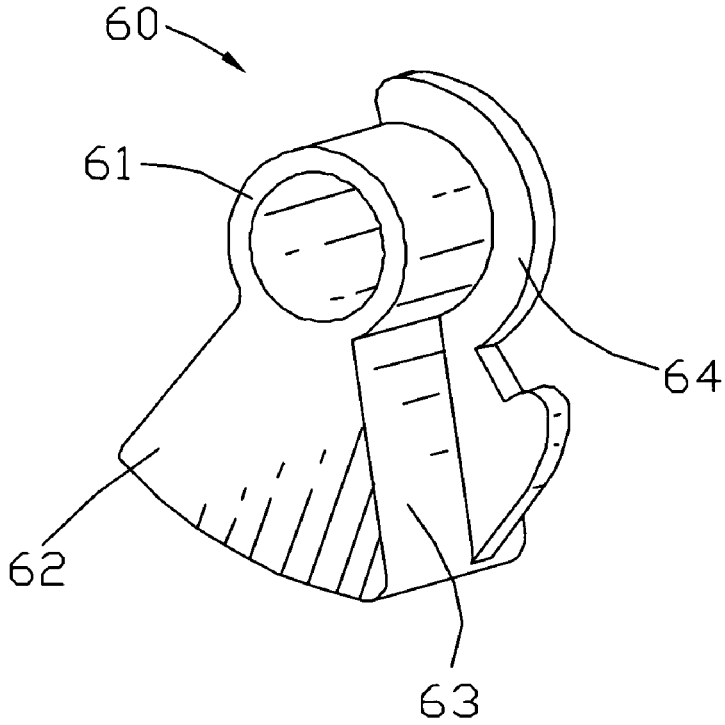
FIG. 6 is a perspective view of a follower member of the sheet-feeding apparatus with a paper stopper.
Figure 7:
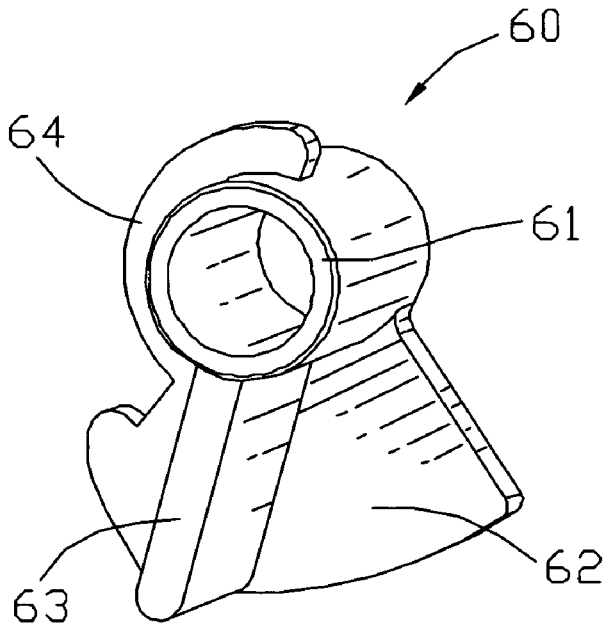
FIG. 7 illustrates the other side of the follower member shown in FIG. 6.
Figure 14:
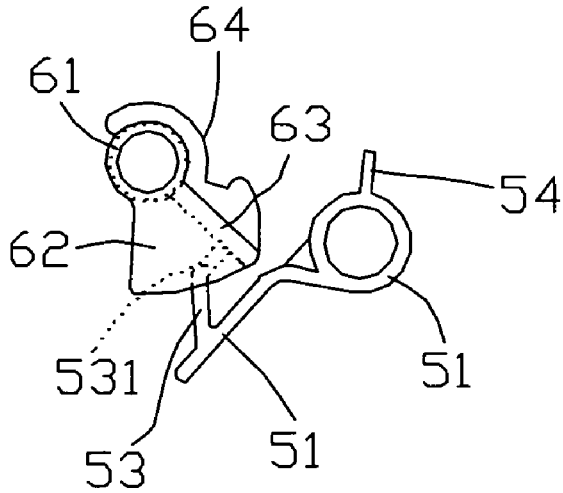

Referring to FIG. 6 in conjunction with FIG. 7, the follower member 60 has a second hinge portion 61 rotationally sleeved on the second shaft 42 of the feeding roller unit 40, an extended edge 64 extending from the middle of the second hinge portion 61, a sector-shaped plane 62 extending from the edge of the second hinge portion 61 and located at one side of the extended edge 64 and, a rectangle follower blade 63 extending along the edge of the sector-shaped plane 62 from the second hinge portion 61. The extended edge 64, the sector-shaped plane 62 and the rectangle follower blade 63 are perpendicular to the second hinge portion 61. The follower blade 63 is driven by the holding end 531 of the holding portion 53 to swing, as can be seen in FIG. 14.

Figure 8:
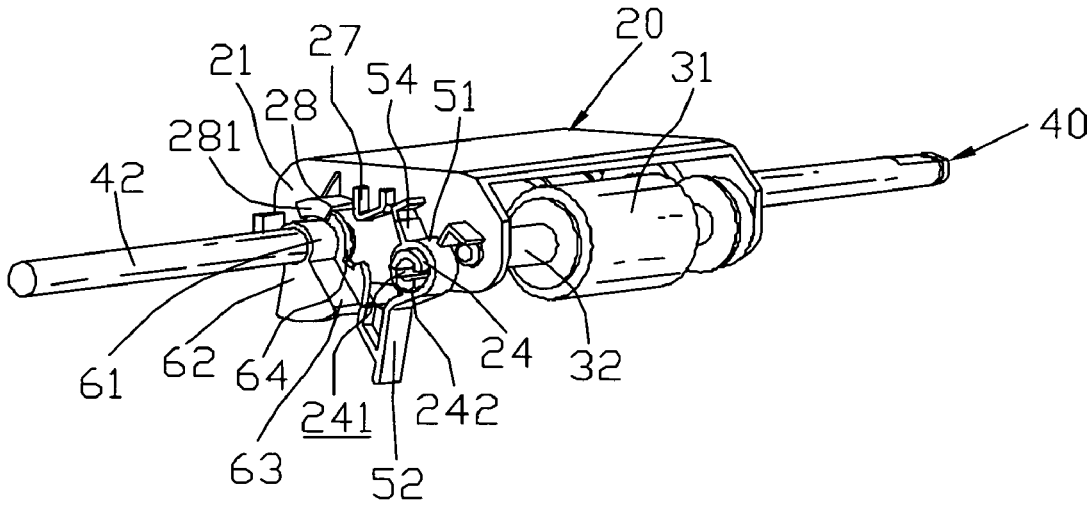
FIG. 8 is a perspective view of a sheet-feeding apparatus with the sheet-feeding base removed.

Referring to FIG. 8 conjunction with FIGS. 1 and 3, the first shaft 32 is disposed in the hinge hole 22 of the side wall 21 for securing the preliminary feeding roller unit 30 in the roller shell 20. The second shaft 42 of the feeding roller unit 40 disposed in the hinge orifice 23 of the side wall 21 for engaging the feeding roller unit 40 with the roller shell 20. The first hinge portion 51 of the stopper member 50 is sleeved on the hinge shaft 24. The first hinge portion 51 is restricted by the protruded end 242 of the hinge shaft 24 to prevent the stopper member 50 from sliding off. Therefore, the stopper member 50 is firmly engaged with the hinge shaft 24. The second shaft 42 passes through the hinge orifice 23, then, the second hinge portion 61 of the follower member 60 is sleeved on the second shaft 42. The extended edge 64 is guided by the U-shaped restricting blade 27 and firmly held by sector face 281 of the cover 28, therefore, the swinging of the follower member 60 is restricted by the U-shaped restricting blade 27 and the sector face 281 of the cover 28 for preventing from over-swinging (shown in FIG. 15) and sliding off.

As shown in FIG. 1, the second shaft 42 rotationally positioned in the sheet-feeding base 10. Additionally, the stopper member 50 and follower member 60 droop into the respective slot 12 under its own weight. The roller shell 20 swings up and down around the second shaft 42.

Figure 9:
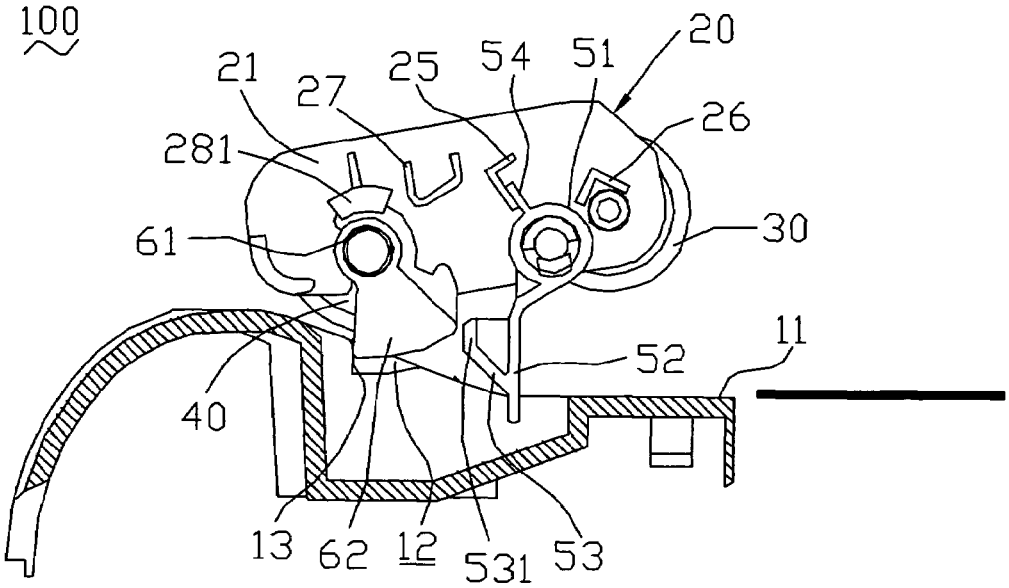
FIGS. 9-17 are cross-sectional views showing the feeding process of the sheet-feeding apparatus with a paper stopper.

FIGS. 9-17 describe the sheet feeding process of the sheet feeding apparatus with a paper stopper 100 according to the present invention. FIG. 9 shows a first position before the sheet is placed. The preliminary feeding roller unit 30 is positioned in a raised position to form an opening for putting the sheet on the sheet-placing stand 11. The supporting blade 54 of the stopper member 50 contacts with stopper blade 25 for preventing stopper member 50 from counter-clockwise swinging under its own weight. The sector-shaped plane 62 of the follower member 60 is placed in the slot 12 of the sheet-feeding base 10 and abuts against the upright wall 13. The upright wall 13 prevents the follower member 60 from over-swinging.

Figure 10:
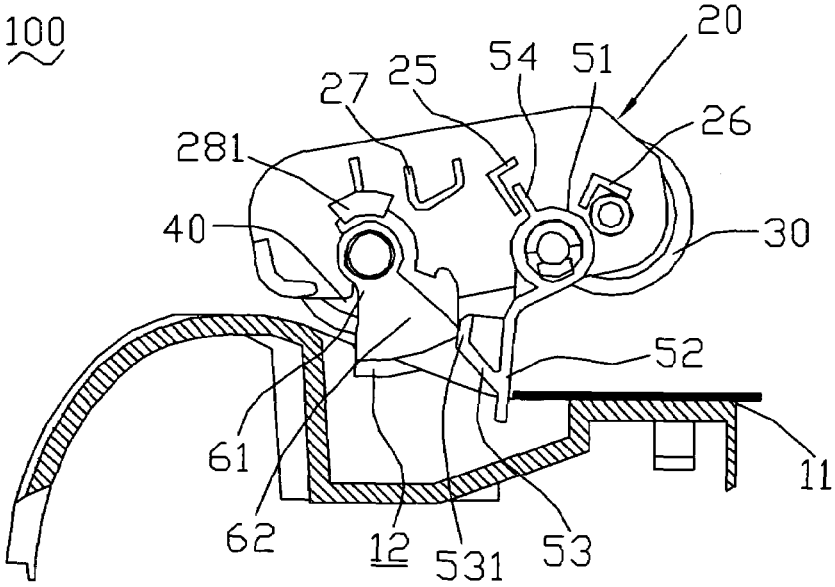

When a sheet is put on the sheet-placing stand 11, as shown in FIG. 10, the sheet stopper bar 52 of the stopper member 50 is pushed by the sheet to move forward in the sheet-transferring direction. Consequently, the holding end 531 of the holding portion 53 presses on the follower blade 63 of the follower member 60. The follower member 60 would not move any further because the follower member 60 is restricted by the upright wall 13. So that, the sheet would not be further fed into the sheet-feeding apparatus 100 before the feeding operation starts.

Figure 11:
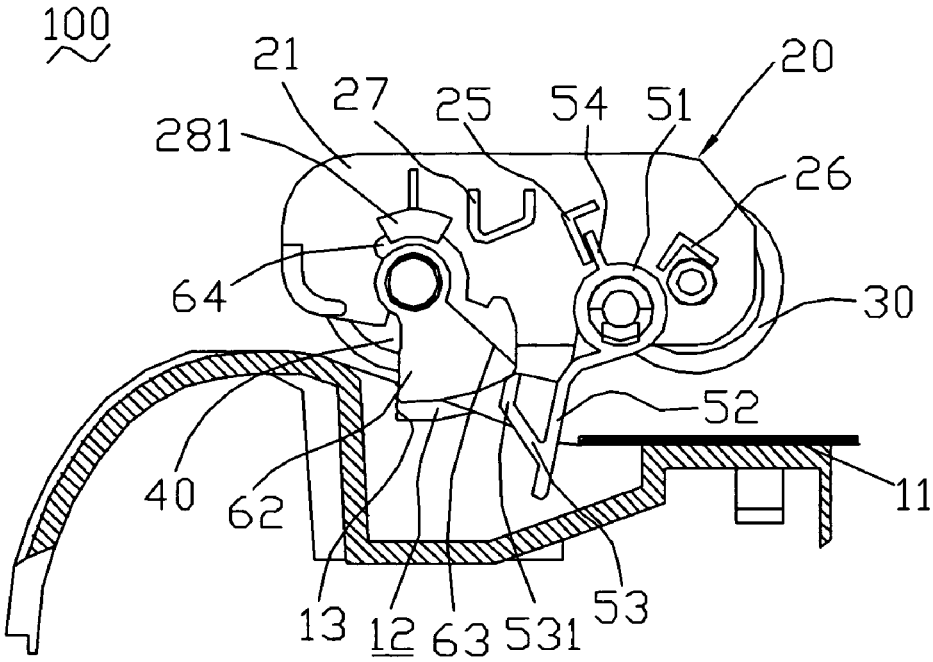

Referring to FIG. 11, when a printing-start button is pushed, the roller shell 20 swings clockwise. Therefore, the holding portion 53 of the stopper member 50 separates from the follower member 60.

Figure 12:
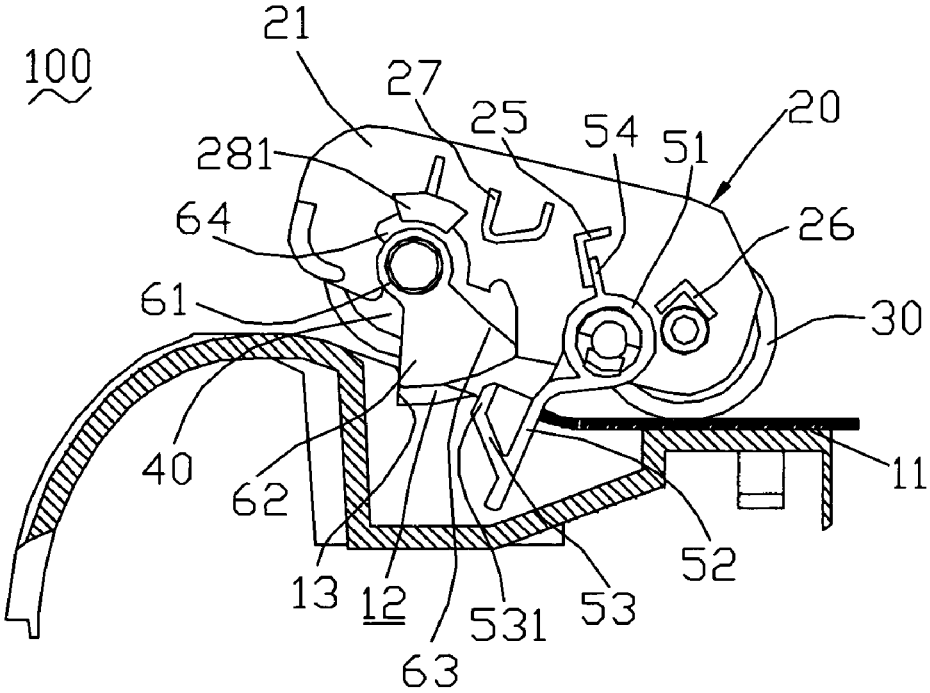

FIG. 12 shows a second position of the sheet-feeding apparatus. The roller shell 20 keeps descending until the preliminary feeding roller unit 30 contacts with the sheet. The stopper member 50 can not counter-clockwise swing due to the supporting blade 54 being held by the stopper blade 25.

Figure 13:
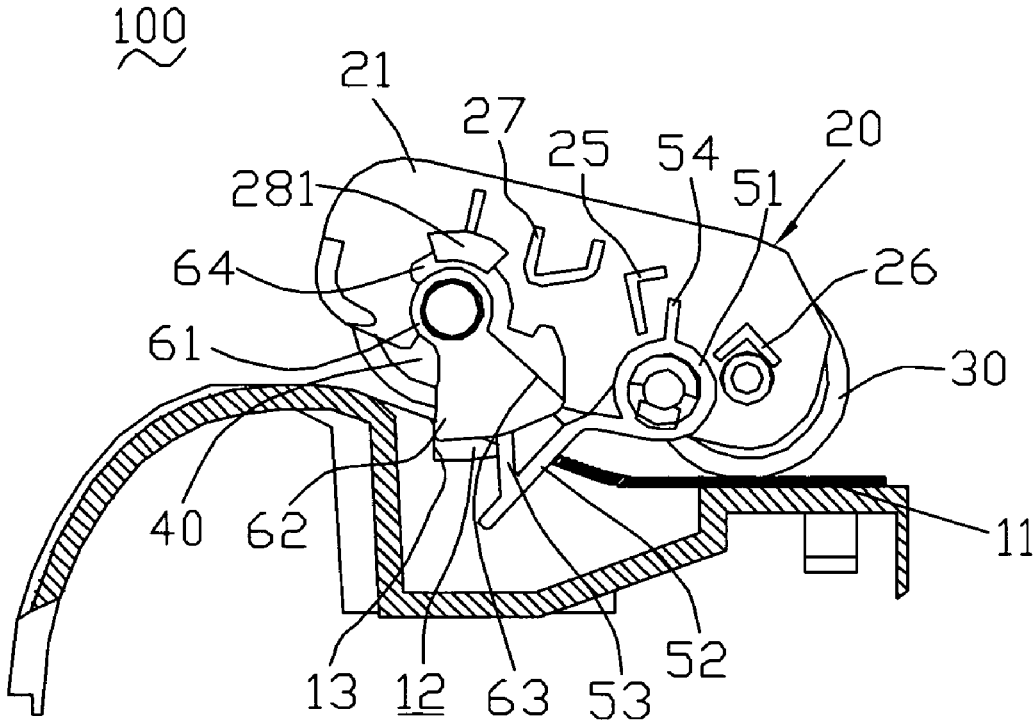

As shown in FIG. 13, when the sheet-feeding apparatus 100 starts to feed sheet, the preliminary feeding roller unit 30 is rotated under external force in the sheet-transferring direction and pushes the sheet to move forward into the sheet-feeding apparatus 100. Consequently, the leading edge of the sheet pushes the sheet stopper bar 52 to swing clockwise. As best seen in FIG. 14, the holding end 531 of the holding portion 53 pushes the follower blade 63 of the follower member 60 and makes the follower member 60 to swing counter-clockwise.

Figure 15:
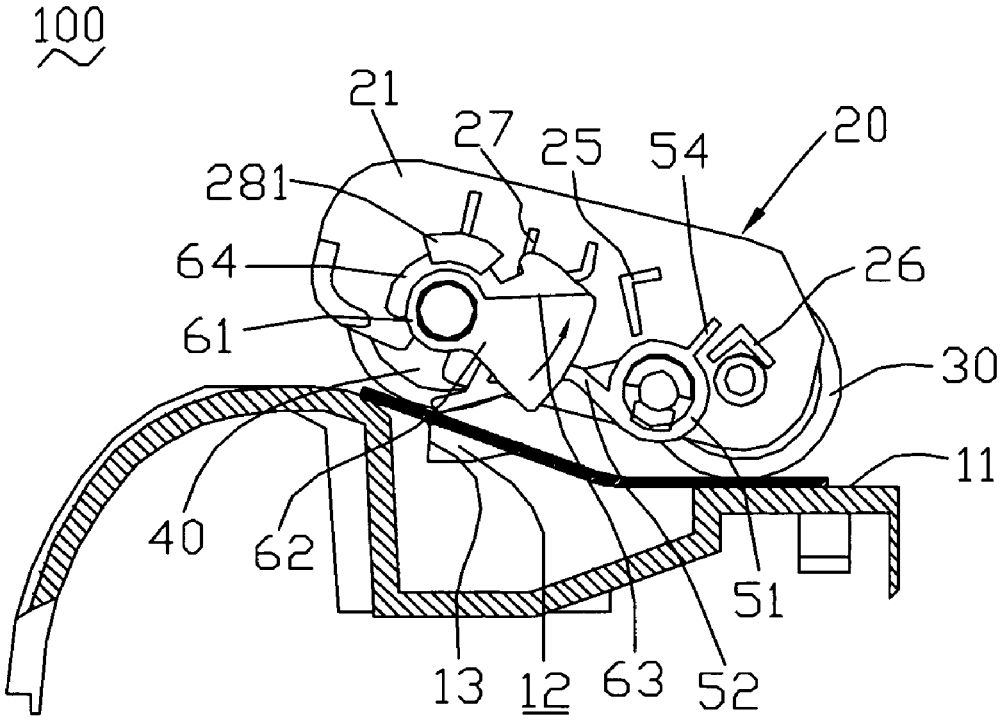
Figure 16:
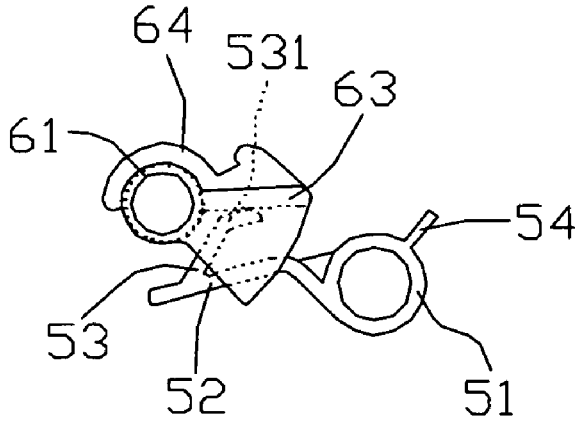

Referring to FIG. 15 conjunction with FIG. 16, as the sheet moving forward, the stopper member 50 and follower member 60 keep swinging. As a result, a gap is formed between the surface of the sheet-placing stand 11 and the follower member 60. Through this gap, the sheet is guided to the feeding roller unit 40. The feeding roller unit 40 is rotated clockwise under external force and keeps the sheet moving forward through the sheet-placing stand 11 and the feeding roller unit 40.

Figure 17:
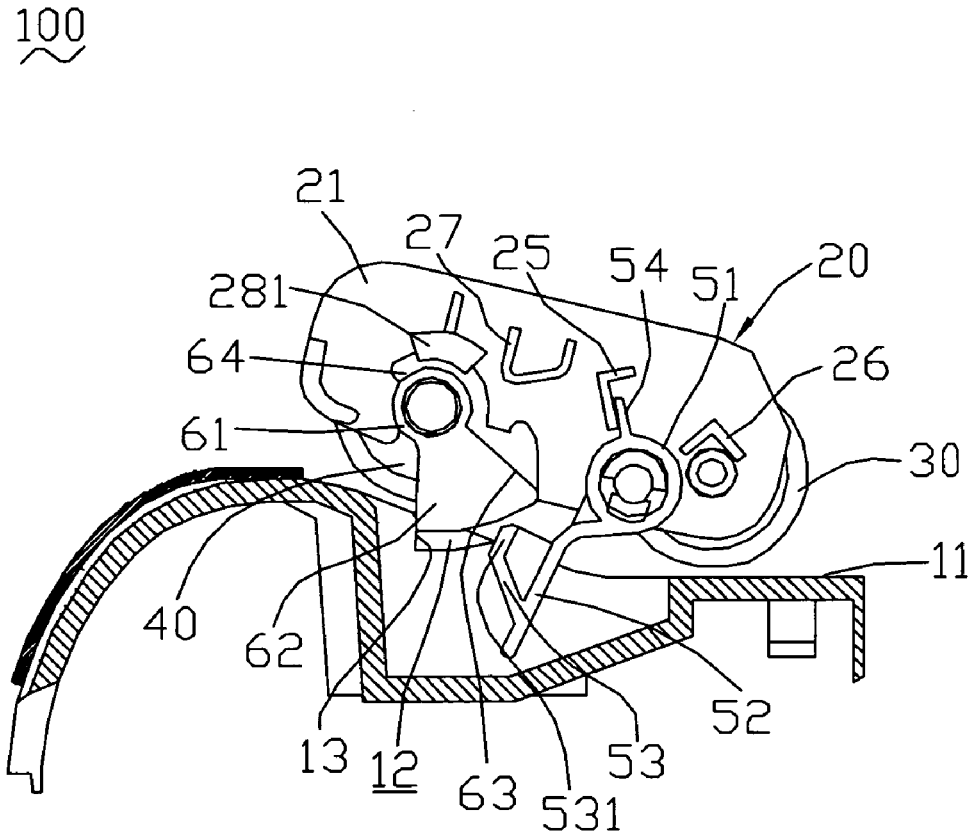
Figure 18:
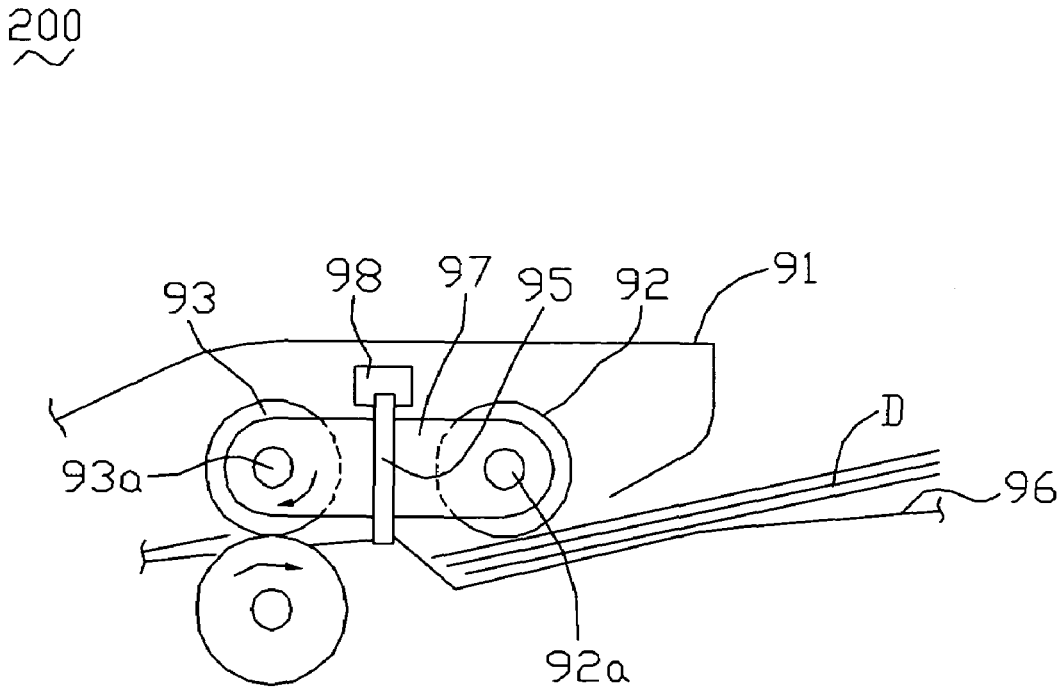
FIG. 18 is a cross-sectional view of a conventional sheet-feeding apparatus.

When the sheet-feeding operation is finished, the stopper member 50 swings down counter-clockwise due to its own weight until the supporting blade 54 contacts with the stopper blade 25 and the holding end 531 of the holding portion 53 separates from the follower member 60. Likewise, the follower member 60 swings down clockwise due to its own weight until the edge of the sector-shaped plane 62 presses on the upright wall 13, as shown in FIG. 17.

In additional, if an unforeseen accident occurs and the stopper member 50 swings clockwise, the stopper blade 26 contacts with the supporting blade 54 to prevent the stopper member 50 from moving any further. Likewise, the U-shaped restricting blade 27 is provided to prevent the follower member 60 from swinging counter-clockwise too much.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A sheet-feeding apparatus with a paper stopper, comprising:

a sheet-feeding base having a sheet-placing stand for placing sheets thereon, a plurality of slots located in the sheet-placing stand and a plurality of upright walls formed at an end of each of the slots, said sheet-placing stand forming a sheet-transferring passage in a sheet-transferring direction;

a roller shell located on said sheet-feeding base, the roller shell having two side walls, each side wall having a hinge hole and a hinge orifice, a hinge shaft protruding from the side wall, a plurality of stopper blades formed on said side walls and arranged at a top side of the hinge shaft, a restricting blade and a cover formed on the side walls and arranged at an up side of the hinge orifice;

a preliminary feeding roller unit having a first shaft and a first roller, the first shaft engaging with the hinge holes of the two side walls of the roller shell;

a feeding roller unit having a second shaft and a second roller, the second shaft passing through the hinge orifices of the two side walls and engaging with said sheet-feeding base, the feeding roller unit located at a downstream side of said preliminary feeding roller unit in said sheet-transferring direction;

a stopper member having a first hinge portion which is rotationally attached to one of the two side walls of said roller shell, a sheet stopper bar extending from said first hinge portion, a holding portion extending from the sheet stopper bar and a supporting blade formed at the first hinge portion, the supporting blade moving between said stopper blades to restrict a swinging angle of said stopper member; and a follower member having a second hinge portion rotationally sleeved on said second shaft of said feeding roller unit and engaged with said sheet-feeding base, a plane extending from the second hinge portion, a follower blade extending from the second hinge portion and an extended edge extending from a middle part of the second hinge portion, the follower blade being driven by said holding portion to swing, the extended edge being guided by said cover and held by said restricting blade to restrict swinging of the follower member, wherein the holding portion of the stopper member presses the follower member to abut against one of the upright walls in a first position to block the sheet-transferring passage, and the sheet stopper bar to swings clockwise for the holding portion to push the follower member to rotate to a second position counter-clockwise away from the upright wall being abutted against to form a gap for the sheet to be guided through the sheet-transferring passage.

2. The sheet-feeding apparatus with a paper stopper as set forth in claim 1, wherein a protruded end extends from an edge of said hinge shaft, said first hinge portion is restricted by said protruded end and said stopper member is firmly engaged with said hinge shaft.

3. The sheet-feeding apparatus with a paper stopper as set forth in claim 1, wherein at least one of said stopper blades is a right-angle stopper blade.

4. The sheet-feeding apparatus with a paper stopper as set forth in claim 1, wherein said restricting blade is a U-shaped restricting blade.

5. The sheet-feeding apparatus with a paper stopper as set forth in claim 1, wherein a sector face protrudes from an edge of said cover to firmly hold said follower member.

* * * * *